US009618196B2

(12) United States Patent
Sun et al.

(10) Patent No.: US 9,618,196 B2
(45) Date of Patent: Apr. 11, 2017

(54) STEAM GENERATOR

(71) Applicant: Dongguan Pheaton Electronic Technology Co., Ltd., Dongguan (CN)

(72) Inventors: Yungming Sun, Dongguan (CN); Shunqing Ye, Dongguan (CN); Linwen Yang, Dongguan (CN); Lanhua Tian, Dongguan (CN)

(73) Assignee: DONGGUAN PHEATON ELECTRONIC TECHNOLOGY CO., LTD., Dongguan (CN)

( * ) Notice: Subject to any disclaimer, the term of this patent is extended or adjusted under 35 U.S.C. 154(b) by 21 days.

(21) Appl. No.: 14/592,107

(22) Filed: Jan. 8, 2015

(65) Prior Publication Data

US 2016/0201894 A1 Jul. 14, 2016

(51) Int. Cl.
*F22B 29/06* (2006.01)
*D06F 75/18* (2006.01)
*F22B 1/28* (2006.01)

(52) U.S. Cl.
CPC ..... *F22B 1/282* (2013.01)

(58) Field of Classification Search
None
See application file for complete search history.

(56) References Cited

U.S. PATENT DOCUMENTS 3,854,032 A * 12/1974 Cooper ..... H05B 7/18 219/121.11
4,480,172 A * 10/1984 Ciciliot ..... F22B 1/288 165/140
4,975,559 A * 12/1990 Frisch ..... A47J 31/0573 392/449
5,523,550 A * 6/1996 Kimura ..... F24H 1/101 219/628
6,748,904 B1 * 6/2004 Chiang ..... F22B 1/288 122/379
7,471,882 B2 * 12/2008 Peebles ..... F24H 1/102 392/311
7,577,343 B2 * 8/2009 Chiang ..... F22B 1/284 122/40
7,756,404 B2 * 7/2010 Schubert ..... F28D 7/026 392/478

(Continued)

*Primary Examiner* — Thor Campbell
(74) *Attorney, Agent, or Firm* — Ming Chow; Sinorica, LLC

(57) ABSTRACT

The present invention relates to the technical field of heating equipment, and particularly to a steam generator, comprising a shell and a heater fixed inside the shell, a gasification chamber for generating steam being formed between the heater and the shell, the gasification chamber being provided with a water inlet and a steam outlet. The gasification chamber comprises stepped or labyrinthic steam passages. As the gasification chamber inside the steam generator provided by the present invention comprises stepped or labyrinthic steam passages, heat both inside and outside the heating element is fully utilized, the steam passage is lengthened, and both the pressure and temperature are increased; consequently, high-temperature steam may be provided. Moreover, the time for ejecting steam is greatly shortened just several seconds from feeding water to ejecting steam, with high heat utilization efficiency. Moreover, the steam generator is small in size.

20 Claims, 8 Drawing Sheets

(56) References Cited

U.S. PATENT DOCUMENTS

| | | | | |
|---|---|---|---|---|
| 8,724,978 | B2 * | 5/2014 | Furumura | F22B 1/28 392/484 |
| 2007/0223894 | A1 * | 9/2007 | Cheung | A61H 33/063 392/405 |
| 2011/0280553 | A1 * | 11/2011 | Hsu | F22B 1/28 392/394 |

* cited by examiner

STEAM GENERATOR

FIELD OF THE INVENTION

The present invention relates to the technical field of heating equipment, and particularly to a steam generator.

BACKGROUND OF THE INVENTION

As heating equipment widely applied in the prior art, steam generators may be applied in hospitals, bathrooms, restaurants, hotels, spinning, metallurgy, garment, packaging, food and other industries. An existing steam generator has therein a heater having an inner cavity, the inner cavity is communicated with a water inlet and a steam outlet, and cold water is fed into the inner cavity and then heated by the heater to become steam which may be ejected from the steam outlet.

Chinese Patent Application No. 201110357288.4 disclosed a novel steam generator, including a water inlet and a heating core capable of electrically heating the fed water, an end cover provided with an inner cavity and forming a gasification chamber in airtight coordination with the heating core being mounted on the heating core, a steam nozzle being formed on the end cover, wherein the heating core is a columnar heat conductor having an outer diameter at one end less than the inner diameter of the end cover, the heat conductor extends into the inner cavity of the end cover and is provided at its top with at least one open cylindrical wall extending upward, and at least one open cylindrical wall extending downward is provided on the top of the inner cavity of the end cover; the heating core and two adjacent cylindrical walls on the end cover are buckled with each other to form at least two gasification chambers, and the adjacent gasification chambers are communicated to each other via a small air duct; and, the water inlet is provided on the heating core and communicated with the first gasification chamber, and the last gasification chamber is communicated with the steam nozzle. The existing steam generator has the disadvantages of low steam temperature, long time taken for steam ejection and large size.

SUMMARY OF THE INVENTION

To overcome the disadvantages and deficiencies of the prior art, an objective of the present invention is to provide a steam generator having high steam temperature, short time taken for steam ejection and small size.

The objective of the present invention is achieved by the following technical solutions: a steam generator is provided, including a shell and a heater fixed inside the shell, a gasification chamber for generating steam being formed between the heater and the shell, the gasification chamber being provided with a water inlet and a steam outlet, wherein the gasification chamber includes stepped or labyrinthic steam passages.

The gasification chamber includes a first stepped steam passage formed between the outside wall of the heater and the inside wall of the shell, the starting end of the first steam passage being communicated with the water inlet.

A plurality of first annular walls, down-up arrayed in turn, are protruded from the outside wall of the heater, with a first stepped slot being formed two adjacent first annular walls; and, each of the first annular walls has a first notch thereon, and the first notches of two adjacent first annular walls are arranged on the outside wall of the heater, opposing to each other.

The gasification chamber includes a second labyrinthic steam passage formed between the top surface of the heater and the inside wall of the shell, the starting end of the second steam passage being communicated with the final end of the first steam passage.

A plurality of annular walls, arrayed outward in turn from the center of the heater, are protruded from the top surface of the heater, with a labyrinthic slot being formed between two adjacent second annular walls; and, each of the second annular walls has a second notch thereon, and the second notches of two adjacent second annular walls are arranged on the top surface of the heater, opposing to each other.

A cavity having a gas guide rod provided therein is formed in the middle of the heater; and, the gasification chamber further includes a third stepped steam passage formed between the gas guide rod and the heater, the starting end of the third steam passage being communicated with the final end of the second steam passage while the final end thereof being communicated with the steam outlet.

A plurality of third annular walls, up-down arrayed in turn, are protruded from the outside wall of the gas guide rod, with a second stepped slot being formed between two adjacent third annular walls; and, each of the third annular walls has a third notch thereon, and the third notches of two adjacent third annular walls are arranged on the outside wall of the gas guide rod, opposing to each other.

A water inlet pipe is provided at the water inlet and disposed on the outside of the shell, and a steam outlet pipe is provided at the steam outlet and disposed on the bottom of the shell.

An upper flange plate is protruded from the bottom of the shell while a lower flange plate is protruded from the bottom of the heater, a sealing ring being sandwiched between the upper flange plate and the lower flange plate which are fixedly connected to each other via a nut; and, a heating tube is provided inside the heater, and the bottom of the heating tube extends out from the bottom of the heater.

A fuse mounting base is fixed on the bottom of the heater while a corresponding mounting slot is formed on the bottom of the heater, a temperature fuse is provided between the fuse mounting base and the fuse mounting slot; and, a thermostat is fixed on the bottom of the heater.

The present invention has the following beneficial effects. The working principles of the present invention are as follows: water enters the water inlet of the heater via a pump and passes through the first stepped first steam passage formed between the outside wall of the heater and the inside wall of the shell, where it is heated by the outside surface of the heater and gradually vaporized; then, steam enters the second labyrinthic steam passage formed between the top surface of the heater and the inside wall of the shell, where it is heated for the second time by the top surface of the heater; subsequently, the steam enters the third stepped steam passage formed between the gas guide rod and the heater, where it is heated for the third time by the inside surface of the heater and a high pressure is formed in the third steam passage, so that high temperature steam is formed and ejected rapidly.

As the gasification chamber inside the steam generator provided by the present invention comprises stepped or labyrinthic steam passages, heat both inside and outside the heating element is fully utilized, the steam passage is lengthened, and both the pressure and temperature are increased; consequently, high-temperature steam may be provided. Moreover, the time taken for steam ejection is greatly shortened just several seconds from feeding water to ejecting steam, with high heat utilization efficiency. Moreover, the steam generator is small in size.

REFERENCE NUMERALS

Figure 1:
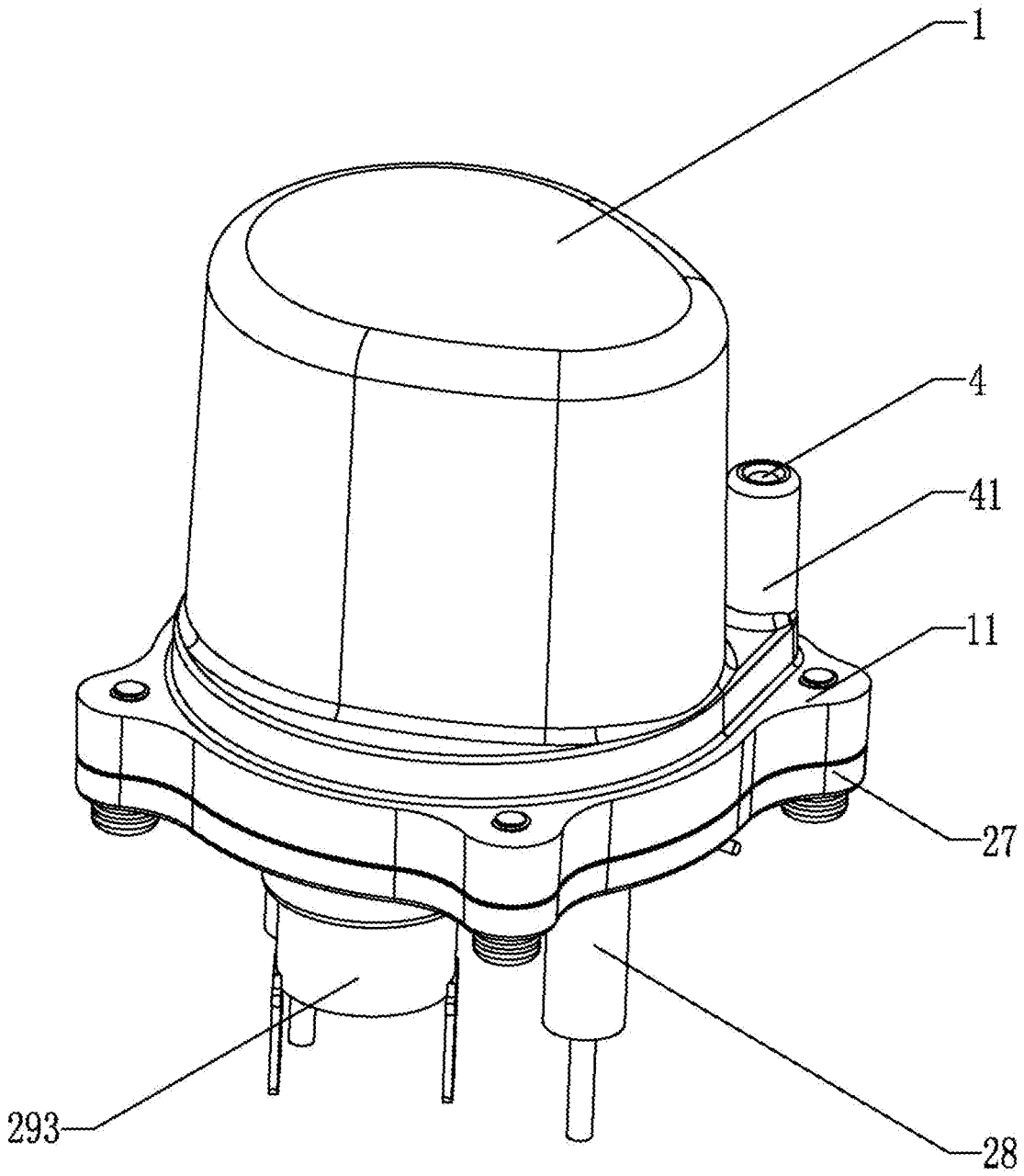
FIG. 1 is a stereoscopically structural diagram of the present invention.
Figure 2:
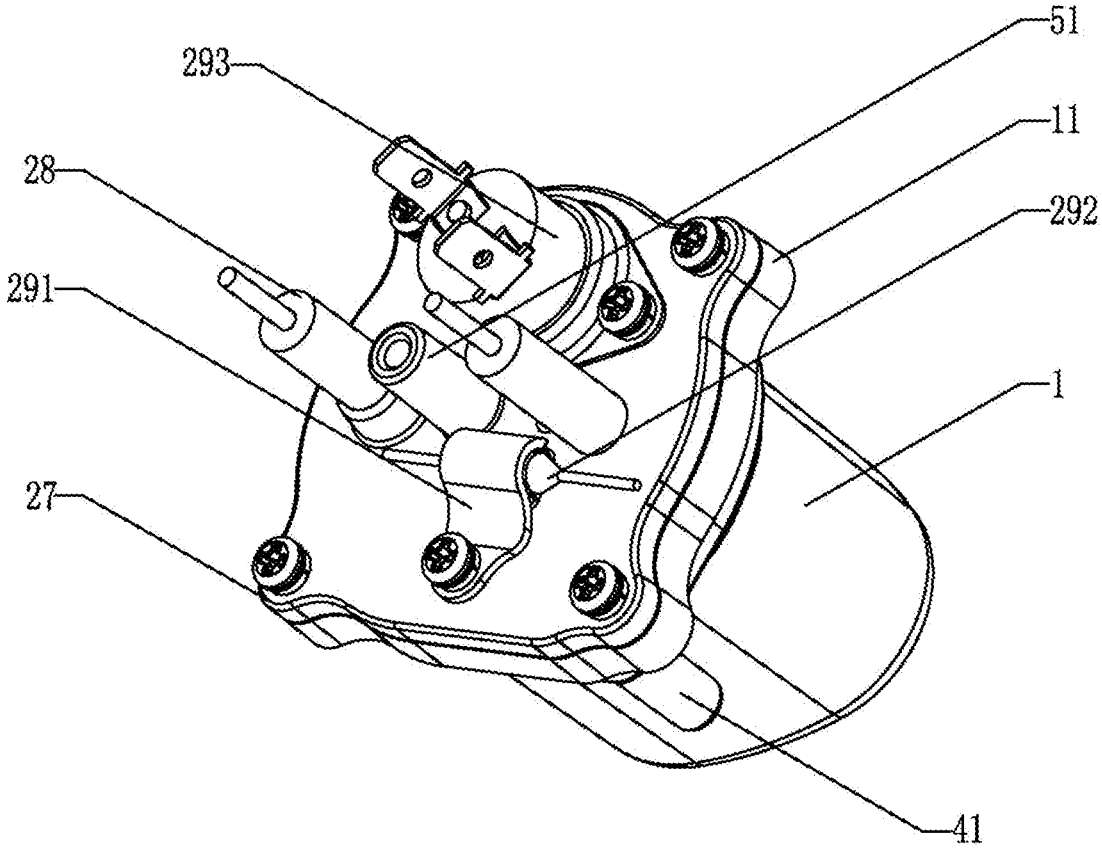
FIG. 2 is a stereoscopically structural diagram of the present invention from another perspective.
Figure 3:
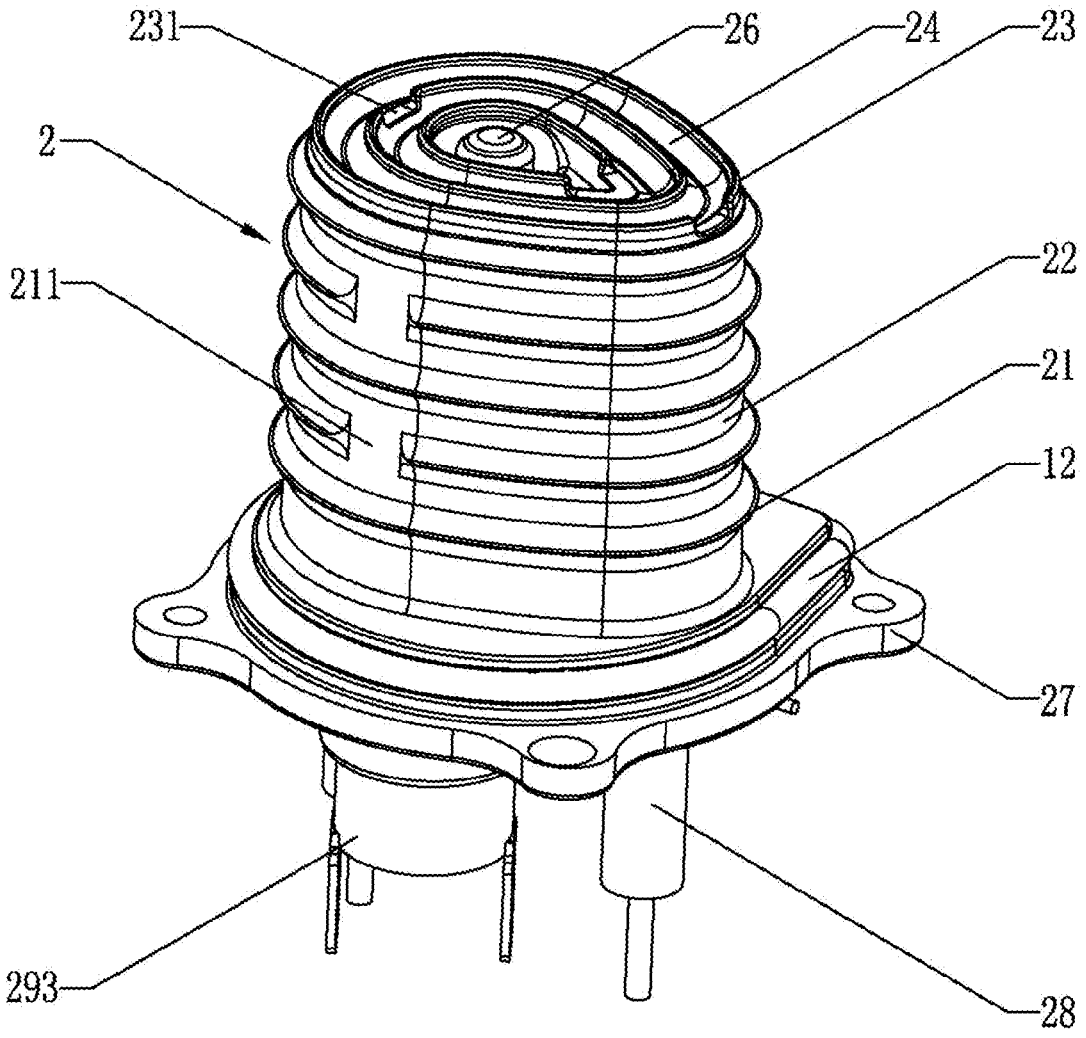
FIG. 3 is a stereoscopically structural diagram of the present invention with the shell removed.
Figure 4:
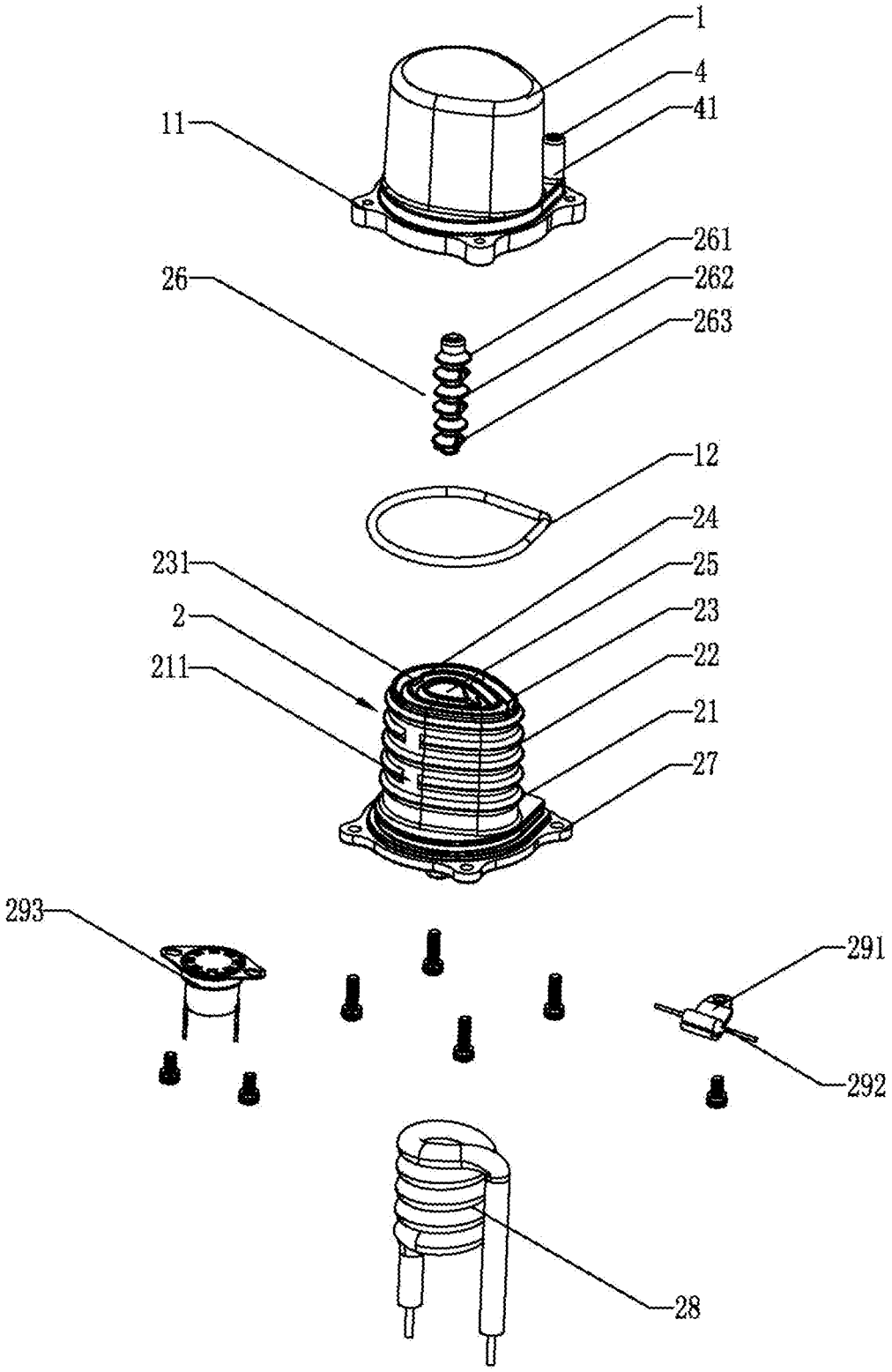
FIG. 4 is a stereoscopically structural decomposition diagram of the present invention.
Figure 5:
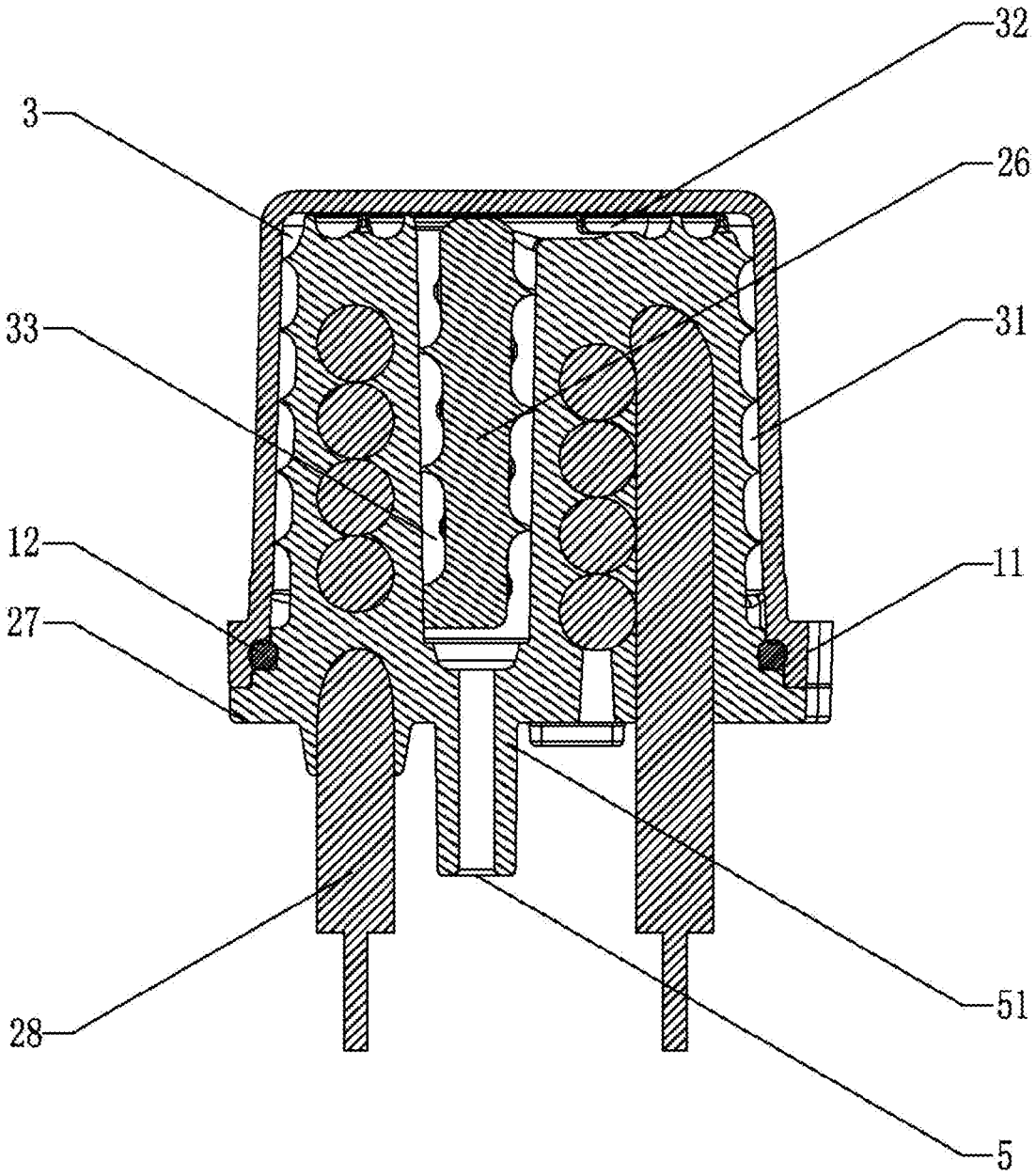
FIG. 5 is a sectional view of the present invention.

1—Shell; 11—Upper flange plate; 12—Sealing ring; 2—Heater; 21—First annular wall; 211—First notch; 22—First stepped slot; 23—Second annular wall; 231—Second notch; 24—Labyrinthic slot; 25—Cavity; 26—Gas guide rod; 261—Third annular wall; 262—Second stepped slot; 263—Third notch; 27—Lower flange plate; 28—Heating tube; 291—Fuse mounting base; 292—Temperature fuse; 293—Thermostat; 3—Gasification chamber; 31—First steam passage; 32—Second steam passage; 33—Third steam passage; 4—Water inlet; 41—Water inlet pipe; 5—Steam outlet; and, 51—Steam outlet pipe.

DETAILED DESCRIPTION OF THE PREFERRED EMBODIMENTS

In order to be understood easily by those skilled in the art, the present invention will be further described with reference to the accompanying drawings 1-8 by embodiments. The contents mentioned in the implementations are not intended to form any limitation to the present invention.

Referring to FIGS. 1-8, a steam generator is provided, including a shell 1 and a heater 2 fixed inside the shell 1. A gasification chamber 3 for generating steam is formed between the heater 2 and the shell 1. The gasification chamber 3 is provided with a water inlet 4 and a steam outlet 5. The gasification chamber 3 includes stepped or labyrinthic steam passages.

As the gasification chamber 3 inside the steam generator provided by the present invention comprises stepped or labyrinthic steam passages, heat both inside and outside the heating element is fully utilized, the steam passage is lengthened, and both the pressure and temperature are increased; consequently, high-temperature steam may be provided. Moreover, the time for ejecting steam is greatly shortened just several seconds from feeding water to ejecting steam, with high heat utilization efficiency. Moreover, the steam generator is small in size.

In this embodiment, the gasification chamber 3 includes a first stepped steam passage 31 formed between the outside wall of the heater 2 and the inside wall of the shell 1, the starting end of the first steam passage 31 being communicated with the water inlet 4. Water enters the water inlet 4 of the heater 2 via a pump and passes through the first stepped steam passage 31 formed between the outside wall of the heater 2 and the inside wall of the shell 1, where it is heated by the outside surface of the heater and gradually vaporized.

Figure 6:
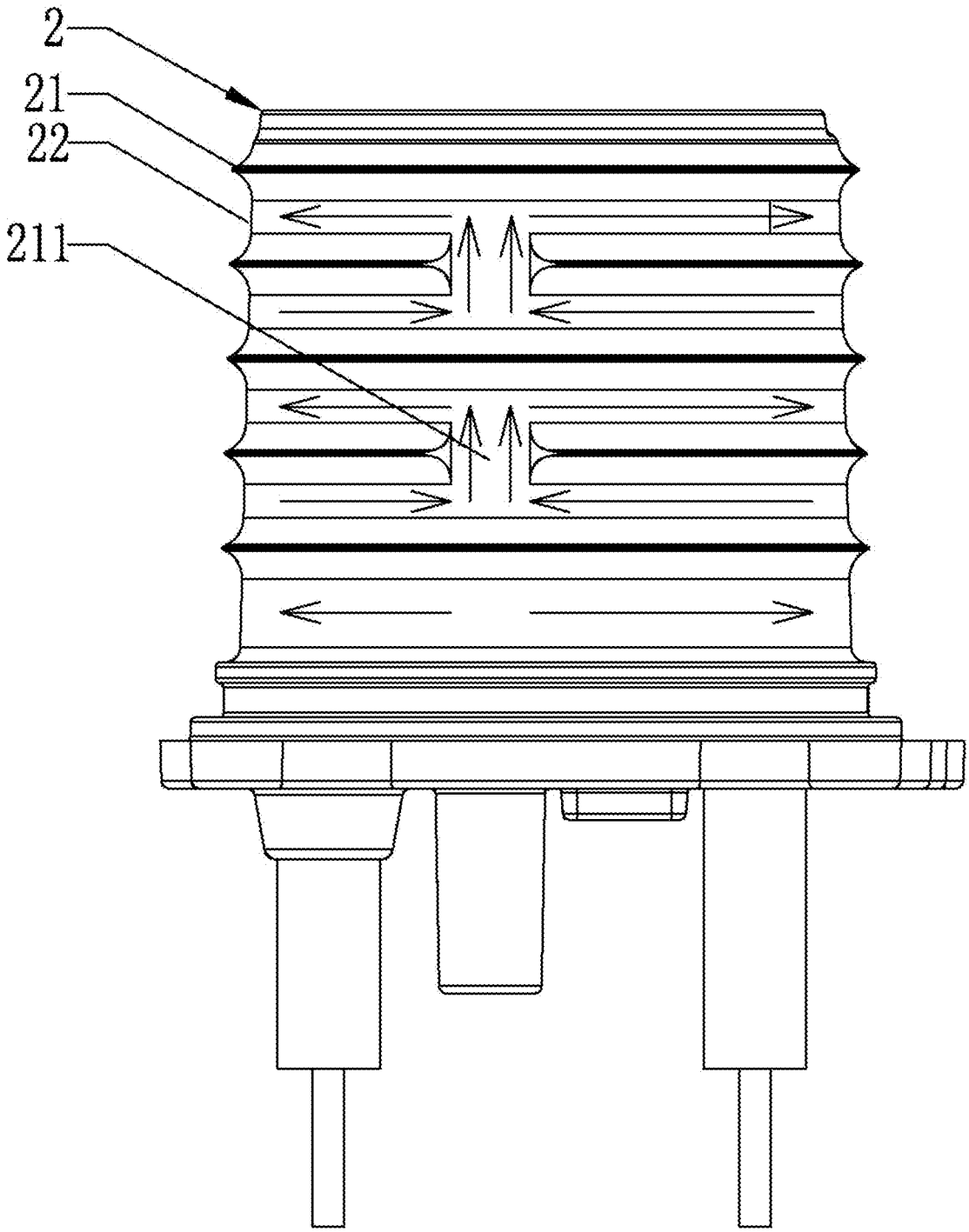
FIG. 6 is a trend chart of steam in a first steam passage of the present invention.

In this embodiment, a plurality of first annular walls 21, down-up arrayed in turn, are protruded from the outside wall of the heater 2, with a first stepped slot 22 being formed two adjacent first annular walls 21; and, each of the first annular walls 21 has a first notch 211 thereon, and the first notches 211 of two adjacent first annular walls 21 are arranged on the outside wall of the heater 2, opposing to each other. There are five first annular walls 21 and five first stepped slots 22, and the cross-section of the heater 2 is oval. As shown in FIG. 6, water enters from the water inlet 4, passes through the bottommost first one of the first stepped slots 22, enters the second one of the first stepped slots 22 from the notch on one side of the bottommost first one of the first stepped slots 22, and enters a next one of the first stepped slots 22 from the notch on the other side of the second one of the first stepped slots 22, and that cycle repeats. The arrangement of the above structure lengthens the first steam passage 31 and increases both the pressure and temperature, thus may provide high-temperature steam and greatly shorten the time taken for steam ejection just several seconds from feeding water to ejecting steam, with large heat utilization efficiency.

In this embodiment, the gasification chamber 3 includes a second labyrinthic steam passage 32 formed between the top surface of the heater 2 and the inside wall of the shell 1, the starting end of the second steam passage 32 being communicated with the final end of the first steam passage 31. Steam enters the second labyrinthic steam passage 32 formed between the top surface of the heater 2 and the inside wall of the shell 1, where it is heated for the second time by the top surface of the heater.

Figure 7:
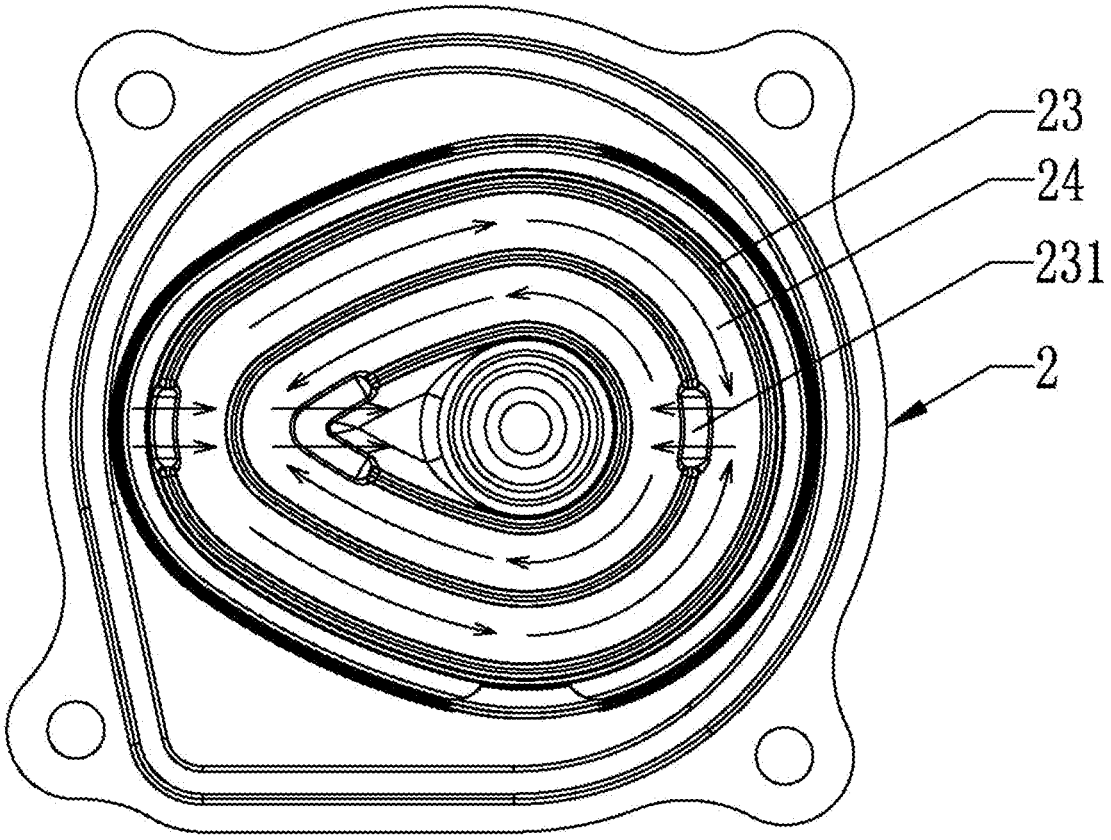
FIG. 7 is a trend chart of steam in a second steam passage of the present invention.

In this embodiment, a plurality of annular walls 23, arrayed outward in turn from the center of the heater 2, are protruded from the top surface of the heater 2, with a labyrinthic slot 24 being formed between two adjacent second annular walls 23; and, each of the second annular walls 23 has a second notch 231 thereon, and the second notches 231 of two adjacent second annular walls 23 are arranged on the top surface of the heater 2, opposing to each other. There are three second annular walls 23 and three labyrinthic slots 24, and both the second annular walls 23 and the labyrinthic slots 24 are oval. As shown in FIG. 7, steam enters from the final end of the first steam passage 31, passes through the first labyrinthic slot 24 on the outer side, enters the second labyrinthic slot 24 from the second notch 231 on one side of the outermost first one of the second annular walls 23, enters the third labyrinthic slot 24 from the notch on the other side of the second one of the second annular walls 23, and then enters the cavity described hereinafter from the notch on one side of the third one of the second annular walls 23. The arrangement of the above structure lengthens the second steam passage and increases both the pressure and temperature, thus may provide high-temperature steam and greatly shorten the time taken for steam ejection just several seconds from feeding water to ejecting steam, with large heat utilization efficiency.

In this embodiment, a cavity 25 having a gas guide rod 26 provided therein is formed in the middle of the heater 2; and, the gasification chamber 3 further includes a third stepped steam passage 33 formed between the gas guide rod 26 and the heater 2, the starting end of the third steam passage 33 being communicated with the final end of the second steam passage 32 while the final end thereof being communicated with the steam outlet 5. An opening, to which the cavity of the heater 2 is communicated, is formed in the center of the top of the heater 2. Then, the steam enters the third stepped steam passage 33 formed between the gas guide rod 26 and the heater 2, where it is heated for the third time by the inside surface of the heater 2 and a high pressure is formed in the third steam passage, so that high-temperature steam is formed and ejected rapidly.

Figure 8:
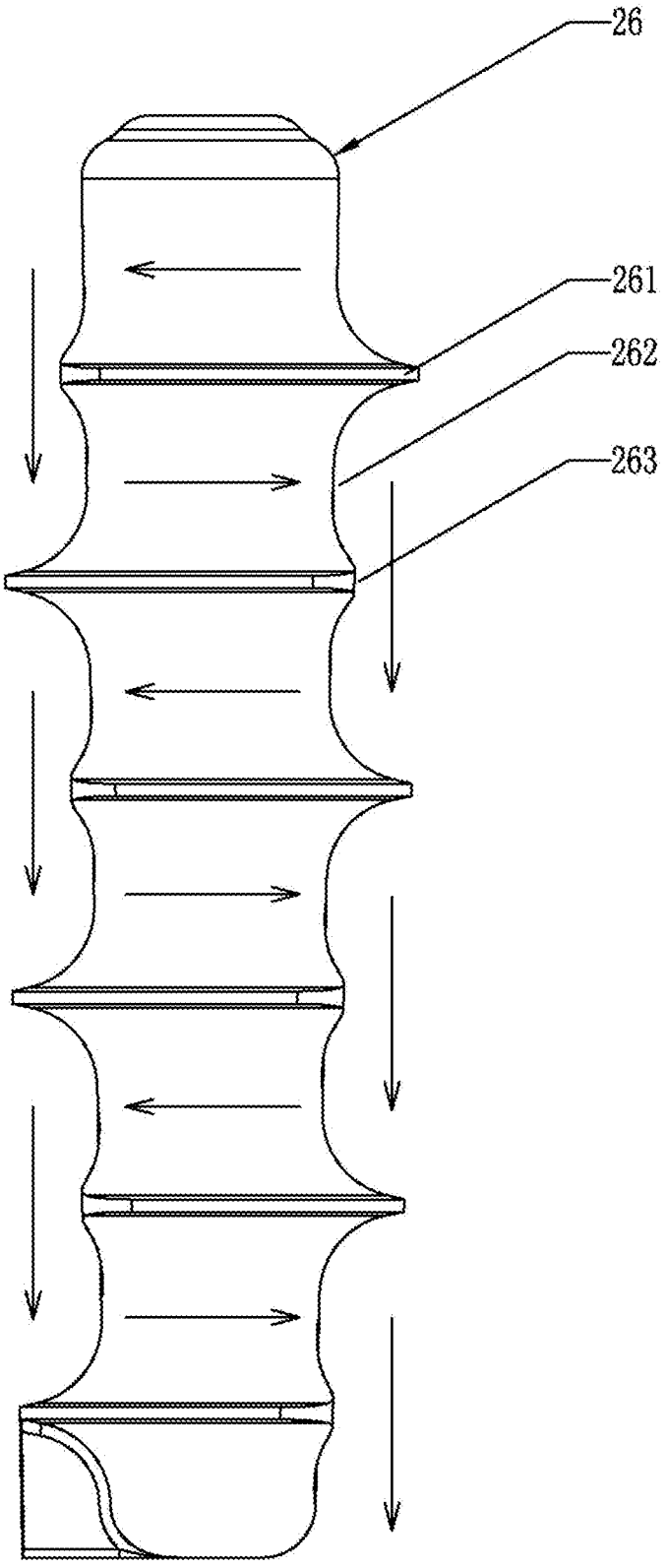
FIG. 8 is a trend chart of steam in a third steam passage of the present invention.

In this embodiment, a plurality of third annular walls 261, up-down arrayed in turn, are protruded from the outside wall of the gas guide rod 26, with a second stepped slot 262 being formed between two adjacent third annular walls 261; and, each of the third annular walls 261 has a third notch 263 thereon, and the third notches 263 of two adjacent third annular walls 261 are arranged on the outside wall of the gas guide rod 26, opposing to each other. There are six third annular walls 261 and six second stepped slots 262. As shown in FIG. 8, water enters from the final end of the second steam passage 32, passes through the topmost first one of the second stepped slots 262, enters the second one of the second stepped slots 262 from the notch on one side of the topmost first one of the third annular walls 261, and then enters a next one of the second stepped slots 262 from the notch on the other side of the second one of the third annular walls 261, and that cycle repeats. The arrangement of the above structure lengthens the third steam passage 33 and increases both the pressure and temperature, thus may provide high-temperature steam and greatly shorten the time taken for steam ejection just several seconds from feeding water to ejecting steam, with large heat utilization efficiency.

In this embodiment, a water inlet pipe 4 is provided at the water inlet 41 and disposed on the outside of the shell, and a steam outlet pipe 51 is provided at the steam outlet 5 and disposed on the bottom of the shell. The openings of the water inlet 4 and the steam outlet 5 are arranged in opposite directions, so that water enters from the water inlet 4 on the top, while steam is ejected from the steam outlet 5 on the bottom, facilitating the feeding of water.

In this embodiment, an upper flange plate 11 is protruded from the bottom of the shell 1 while a lower flange plate 27 is protruded from the bottom of the heater 2, a sealing ring 12 being sandwiched between the upper flange plate 11 and the lower flange plate 27 which are fixedly connected to each other via a nut; and, a heating tube 28 is provided inside the heater 2, and the bottom of the heating tube 28 extends out from the bottom of the heater 2. The arrangement of the upper flange plate 11 and the lower flange plate 27 is convenient for the assembling of the shell 1 and the heater 2, the arrangement of the sealing ring 12 is used for enhancing the air-tightness between the shell 1 and the heater 2, and the arrangement of the heating tube 28 is used for heating the heater 2.

In this embodiment, a fuse mounting base 291 is fixed on the bottom of the heater 2 while a corresponding mounting slot (not shown) is formed on the bottom of the heater 2, a temperature fuse 292 being provided between the fuse mounting base 291 and the fuse mounting slot; and, a thermostat 293 is fixed on the bottom of the heater 2. The temperature fuse 292 may cut the circuit off and thus avoid fire hazards by sensing overheat generated during the abnormal operation of electric appliances and electronic products. The thermostat 293 is a temperature sensing device for maintaining the heater 2 within a certain temperature range by automatically turning on or off the circuit during normal operation.

The working principles of the present invention are as follows: water enters the water inlet 4 of the heater 2 via a pump and passes through the first stepped first steam passage 31 formed between the outside wall of the heater 2 and the inside wall of the shell 1, where it is heated by the outside surface of the heater and gradually vaporized; then, steam enters the second labyrinthic steam passage 32 formed between the top surface of the heater 2 and the inside wall of the shell 1, where it is heated for the second time by the top surface of the heater; subsequently, the steam enters the third stepped steam passage 33 formed between the gas guide rod 26 and the heater 2, where it is heated for the third time by the inside surface of the heater 2 and a high pressure is formed in the third steam passage, so that high temperature steam is formed and ejected rapidly.

The above embodiments are just preferred implementation solutions of the present invention. In addition to the above embodiments, the present invention may be implemented in other forms. Any apparent replacements made without departing from the concept of the present invention shall fall into the protection scope of the present invention.

What is claimed is:

1. A steam generator comprising:
- a shell;
- a heater;
- the heater being fixed inside the shell;
- a gasification chamber;
- the gasification chamber being adapted for generating a steam;
- the gasification chamber being formed in between the heater and the shell;
- a water inlet;
- a steam outlet;
- the water inlet and the steam outlet being provided on the gasification chamber;
- a plurality of annular walls;
- the plurality of annular walls being arrayed outward in turn from a center of the heater;
- the plurality of annular walls being protruded from a top surface of the heater;
- a labyrinthic slot;
- the labyrinthic slot being formed in between two adjacent annular walls among the plurality of annular walls; and
- the annular wall and the labyrinthic slot each being of an oval shape.

2. The steam generator according to claim 1 further comprising:
- the gasification chamber comprising a first stepped steam passage;
- the first stepped steam passage being formed in between an outside wall of the heater and an inside wall of the shell; and
- a starting end of the first stepped steam passage being communicated with the water inlet.

3. The steam generator according to claim 1 further comprising:
- a plurality of first annular walls, down-up arrayed in turn, being protruded from an outside wall of the heater, with a first stepped slot being formed in between two adjacent first annular walls among the plurality of first annular walls;
- each of the plurality of first annular walls comprising a first notch; and
- the two first notches of the two adjacent first annular walls being arranged on the outside wall of the heater, opposing to each other.

4. The steam generator according to claim 2 further comprising:
- the gasification chamber further comprising a second labyrinthic steam passage;

the second labyrinthic steam passage being formed in between the top surface of the heater and the inside wall of the shell; and a starting end of the second labyrinthic steam passage being communicated with a final end of the first stepped steam passage.

5. The steam generator according to claim 1 further comprising:

each of the plurality of annular walls comprising a notch; and the two notches of the two adjacent annular walls being arranged on the top surface of the heater, opposing to each other.

6. The steam generator according to claim 4 further comprising:

a cavity;

a gas guide rod;

the gas guide rod being provided in the cavity;

the cavity being formed in a middle of the heater;

the gasification chamber further comprising a third stepped steam passage;

the third stepped steam passage being formed in between the gas guide rod and the heater; and a starting end of the third stepped steam passage being communicated with a final end of the second labyrinthic steam passage while a final end of the third stepped steam passage being communicated with the steam outlet.

7. The steam generator according to claim 6 further comprising:

a plurality of third annular walls, up-down arrayed in turn, being protruded from an outside wall of the gas guide rod, with a second stepped slot being formed in between two adjacent third annular walls among the plurality of third annular walls;

each of the plurality of third annular walls comprising a third notch; and the two third notches of the two adjacent third annular walls being arranged on the outside wall of the gas guide rod, opposing to each other.

8. The steam generator according to claim 1 further comprising:

the water inlet comprising a water inlet pipe;

the water inlet pipe being disposed on an outside of the shell;

the steam outlet comprising a steam outlet pipe; and the steam outlet pipe being disposed on a bottom of the shell.

9. The steam generator according to claim 1 further comprising:

the shell comprising an upper flange plate;

the heater comprising a lower flange plate;

the upper flange plate being protruded from a bottom of the shell;

the lower flange plate being protruded from a bottom of the heater;

a sealing ring;

the sealing ring being sandwiched in between the upper flange plate and the lower flange plate;

a nut;

the upper flange plate and the lower flange plate being fixedly connected to each other via the nut;

the heater further comprising a heating tube;

the heating tube being provided inside the heater; and a bottom of the heating tube extending out from the bottom of the heater.

10. The steam generator according to claim 1 further comprising:

a fuse mounting base;

the fuse mounting base being fixed on a bottom of the heater;

a fuse mounting slot;

the fuse mounting slot corresponding to the fuse mounting base;

the fuse mounting slot being formed on the bottom of the heater;

a temperature fuse;

the temperature fuse being provided in between the fuse mounting base and the fuse mounting slot;

a thermostat; and the thermostat being fixed on the bottom of the heater.

11. A steam generator comprising:

a shell;

a heater;

the heater being fixed inside the shell;

a gasification chamber;

the gasification chamber being formed in between the heater and the shell;

a water inlet;

a steam outlet;

the water inlet and the steam outlet being provided on the gasification chamber;

the gasification chamber comprising a first stepped steam passage, a second labyrinthic steam passage and a third stepped steam passage;

the water inlet, the first stepped steam passage, the second labyrinthic steam passage, the third stepped steam passage and the steam outlet being communicated with one another;

a plurality of annular walls;

the plurality of annular walls being arrayed outward in turn from a center of the heater;

the plurality of annular walls being protruded from a top surface of the heater;

a labyrinthic slot;

the labyrinthic slot being formed in between two adjacent annular walls among the plurality of annular walls; and the annular wall and the labyrinthic slot each being of an oval shape.

12. The steam generator according to claim 11 further comprising:

the first stepped steam passage being formed in between an outside wall of the heater and an inside wall of the shell; and a starting end of the first stepped steam passage being communicated with the water inlet.

13. The steam generator according to claim 11 further comprising:

a plurality of first annular walls, down-up arrayed in turn, being protruded from an outside wall of the heater, with a first stepped slot being formed in between two adjacent first annular walls among the plurality of first annular walls;

each of the plurality of first annular walls comprising a first notch; and the two first notches of the two adjacent first annular walls being arranged on the outside wall of the heater, opposing to each other.

14. The steam generator according to claim 11 further comprising:

the second labyrinthic steam passage being formed in between the top surface of the heater and the inside wall of the shell; and a starting end of the second labyrinthic steam passage being communicated with a final end of the first stepped steam passage.

15. The steam generator according to claim 1 further comprising:

each of the plurality of annular walls comprising a notch; and the two notches of the two adjacent annular walls being arranged on the top surface of the heater, opposing to each other.

16. The steam generator according to claim 11 further comprising:

a cavity;

a gas guide rod;

the gas guide rod being provided in the cavity;

the cavity being formed in a middle of the heater;

the third stepped steam passage being formed in between the gas guide rod and the heater; and a starting end of the third stepped steam passage being communicated with a final end of the second labyrinthic steam passage while a final end of the third stepped steam passage being communicated with the steam outlet.

17. The steam generator according to claim 16 further comprising:

a plurality of third annular walls, up-down arrayed in turn, being protruded from an outside wall of the gas guide rod, with a second stepped slot being formed in between two adjacent third annular walls among the plurality of third annular walls;

each of the plurality of third annular walls comprising a third notch; and the two third notches of the two adjacent third annular walls being arranged on the outside wall of the gas guide rod, opposing to each other.

18. The steam generator according to claim 11 further comprising:

the water inlet comprising a water inlet pipe;

the water inlet pipe being disposed on an outside of the shell;

the steam outlet comprising a steam outlet pipe; and the steam outlet pipe being disposed on a bottom of the shell.

19. The steam generator according to claim 11 further comprising:

the shell comprising an upper flange plate;

the heater comprising a lower flange plate;

the upper flange plate being protruded from a bottom of the shell;

the lower flange plate being protruded from a bottom of the heater;

a sealing ring;

the sealing ring being sandwiched in between the upper flange plate and the lower flange plate;

a nut;

the upper flange plate and the lower flange plate being fixedly connected to each other via the nut;

the heater further comprising a heating tube;

the heating tube being provided inside the heater; and a bottom of the heating tube extending out from the bottom of the heater.

20. The steam generator according to claim 11 further comprising:

a fuse mounting base;

the fuse mounting base being fixed on a bottom of the heater;

a fuse mounting slot;

the fuse mounting slot corresponding to the fuse mounting base;

the fuse mounting slot being formed on the bottom of the heater;

a temperature fuse;

the temperature fuse being provided in between the fuse mounting base and the fuse mounting slot;

a thermostat; and the thermostat being fixed on the bottom of the heater.

* * * * *